United States Patent [19]

Storms

[11] 4,136,805

[45] Jan. 30, 1979

[54] WRIST BAND HOLDER FOR ELECTRONIC CALCULATOR

[75] Inventor: William L. Storms, Costa Mesa, Calif.

[73] Assignee: Alpha Nova Development Corp., Santa Ana, Calif.

[21] Appl. No.: 812,108

[22] Filed: Jul. 1, 1977

[51] Int. Cl.[2] ..... A45F 5/00

[52] U.S. Cl. ..... 224/28 R; 224/25 R; 224/5 H; 248/310

[58] Field of Search ..... 224/28 R, 28 A, 28 D, 224/25 R, 26 R, 26 B, 26 E, 5 R, 28 B, 28 W, 28 C, 4 B, 4 A, 4 C, 4 F, 5 A, 5 B, 5 H, 29 B, 29 E; 248/310, 228; 24/17 B

[56] References Cited

U.S. PATENT DOCUMENTS

| | | | |
|---|---|---|---|
| 956,534 | 5/1910 | Lahey | 24/17 B |
| 1,240,527 | 9/1917 | Allen | 224/4 F UX |

*Primary Examiner*—Trygve M. Blix
*Assistant Examiner*—Jerold M. Forsberg
*Attorney, Agent, or Firm*—William C. Babcock

[57] ABSTRACT

A clamping device adapted to be secured on the wrist of a person and conformed to retain portable calculators of various sizes thereat. In a first embodiment the clamping device comprises an angulated base plate including wrist band receiving slots along the lateral edges thereof and provided with an outwardly extending longitudinal securing lip. The base plate surface subjacent the wrist band furthermore, includes two transverse surface recesses conformed to receive at various depths of insertion, two parallel tongues extending from a locking plate similarly provided with a longitudinal retaining lip. Both the tongues and the recesses and the interiorly opposed surfaces of the locking lip each include longitudinal serrations biased to maintain the calculator in position and to provide an engaging interface. In a second embodiment a single, unitary, structure is utilized to form the base plate, such base plate including two spirally wound longitudinal edges which by spring deformation retain the calculator.

2 Claims, 4 Drawing Figures

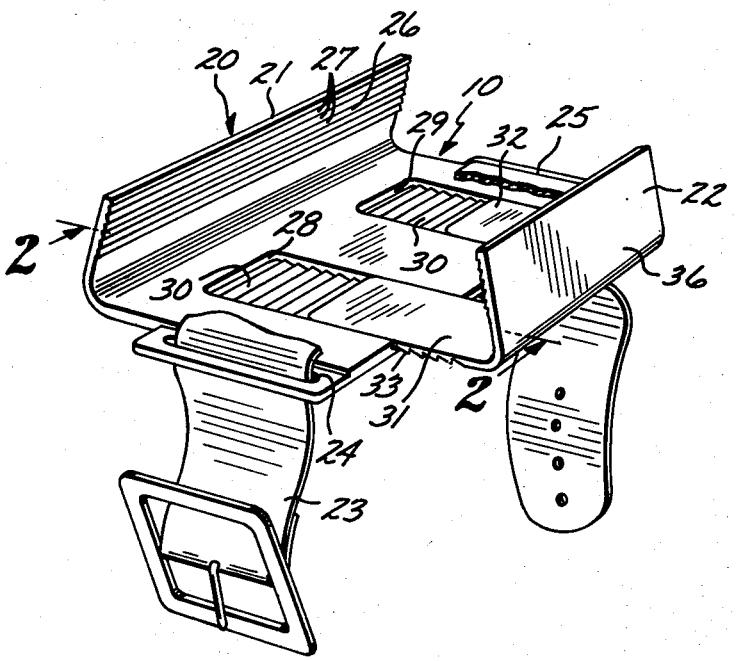
FIG. 1
FIG. 2
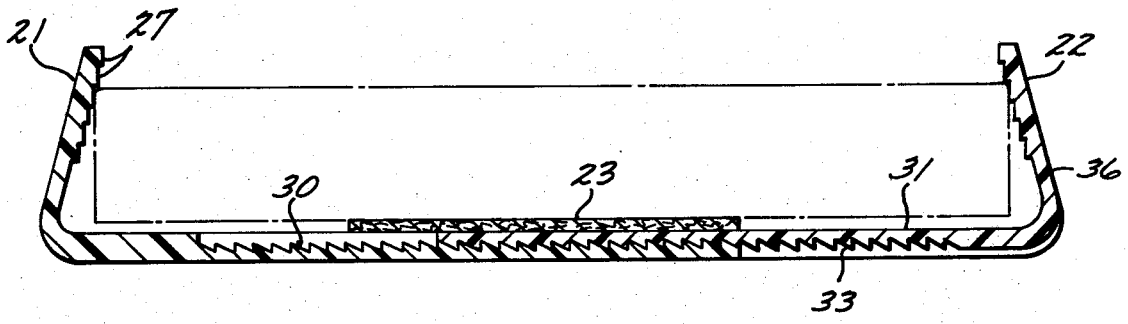
FIG. 3
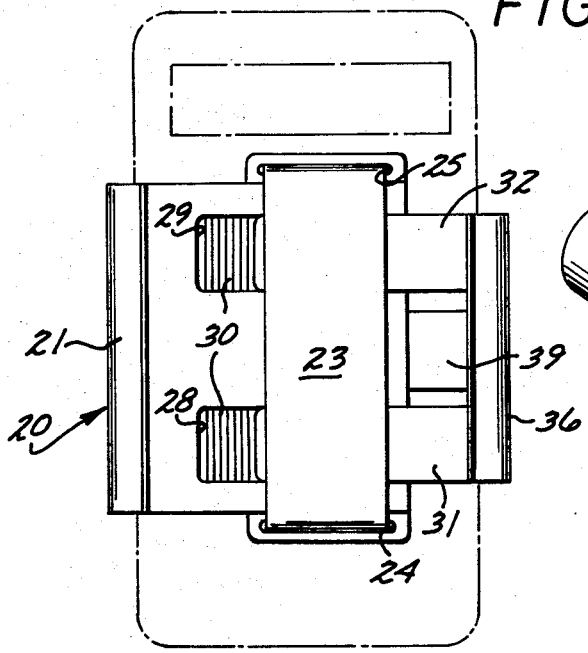
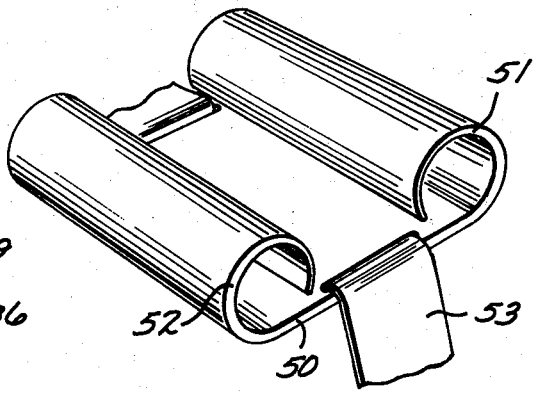
FIG. 4

WRIST BAND HOLDER FOR ELECTRONIC CALCULATOR

BACKGROUND OF THE INVENTION

1. Field of the Invention

The present invention relates to retaining devices, and more particularly to wrist band secured devices for retaining portable calculators.

2. Description of the Prior Art

As advances in solid state physics and miniaturization go forth the size of calculators continues to decrease, often with a concurrent increase in functions. Typically, however, the calculator, whether it be simple or complex, requires both the facilities for manual input and a visual read-out, each of these dictating a minimum size beyond which further decreases are no longer practical. Thus, the size of a calculator with present day technology, is most often determined by the functions provided, i.e. by the number of manual inputs which are necessary in order to select these functions.

As a result of this miniaturization there has been a recent trend incorporating a calculator in a wrist watch module. This utility in deploying a calculator on the wrist of a person has had first recognition in the art of digital watches where the logic provided to implement the clock is also used to perform some of the most basic calculations. Thus, for example, in U.S. Pat. No. 3,298,960 this exact feature is achieved, this patent providing the concurrent use of the same digital logic to maintain time and to perform calculations. In this configuration, however, the face of the calculator is necessarily limited to the size of a typical watch, and the number functions and manipulative convenience are therefore highly limited. In addition, the physical structure of the housing is particularly directed to contain one specific circuit, and is therefore not adapted to expanded use.

SUMMARY OF THE INVENTION

Accordingly, it is the general purpose and object of the present invention to provide a retaining device deployable on the wrist of a person, the retaining device being adapted to secure calculators of various sizes.

Other objects of the invention are to provide a retaining device combined with a wrist band wherein the wrist band is used to advantage in accommodating the expansion features therein.

Yet additional objects of the invention are to provide retaining device deployable on the wrist of a person for securing electronic packages of various dimensions.

Yet further objects of the invention are to provide a retaining device for securing calculators to the wrist of a person, the retaining device includes few parts with the attendant convenience in manufacture and maintenance.

Briefly, these and other objects are accomplished in the present invention by providing a clamping device which includes elongate slots proximate the lateral edges thereof through which a flexible strap or wrist band is passed for securing the device to the wrist of the user. In a first embodiment the clamping device itself comprises two slidably engaged interlocking bracket halves, one providing the function of a base plate and therefore including the above-mentioned laterally disposed slots, and the other being translated over the interior surface of the base plate to achieve the desired separation for securing a calculator of particular dimensions. The base plate itself is formed in the manner of an angulated surface of a material like ABS or other similar plastic, and the surface being dimensioned to approximate a rectangle, having aforementioned slots formed along the lateral edges thereof. One longitudinal edge of the rectangular base plate is convolved to extend substantially normally therefrom, the convolution providing an angle somewhat smaller than 90° to align the edge in partially overlapping arrangement over the base plate surface. Formed on the interior of the base plate surface are two parallel, laterally aligned recesses or grooves, each including longitudinal serrations biased towards the longitudinal lip or edges. Received within these recesses are two parallel tongues extending from a locking plate which forms the other half of the bracket, the tongues being similarly provided with longitudinal serrations conformed to mate with the serrations and the recesses. The locking plate, similar to the base plate, includes a longitudinal inwardly directed lip, both lips furthermore including longitudinal serrations on the interior surface thereof. By virtue of this arrangement of parts, the separation between the lip on the base plate and the lip on the locking plate can be manually adjusted and the wrist strap passing through the two slots on the edges of the base plate then provides the necessary retaining force engaging the tongues within the corresponding recesses. The serrations on the interior surface of the lip then retains a calculator therebetween.

In an alternative embodiment, a single structure is utilized to provide the same function, the structure being conformed once more in the manner of a rectangle, the longitudinal edges thereof being curled along an inward spiral to provide a gap therebetween into which the calculator is pressed. In order to achieve the necessary spring coefficients, it is intended to form this latter retaining device from a material like polyethylene, the surface thickness thereof being furthermore tapered along the spiral curl in a substantially equal relationship with the local spiral radius.

BRIEF DESCRIPTION OF THE DRAWINGS

FIG. 1 is a perspective illustration of a retaining device constructed according to the present invention;

FIG. 2 is a side view, end section, taken along line 2—2 of FIG. 1;

FIG. 3 is a top view of the retaining device shown in FIG. 1; and

FIG. 4 is a perspective illustration of yet another embodiment of the retaining device constructed according to the present invention.

DESCRIPTION OF THE PREFERRED EMBODIMENT

As shown in FIGS. 1, 2 and 3 a retaining device generally designated by the numeral 10 comprises a bracket assembly 20 including a first and second half, respectively 21 and 22. Bracket halves 21 and 22 form a clamping structure retained on the wrist of a user by a wrist strap 23. More specifically bracket half 21 forms the base plate for the bracket being dimensioned as a rectangular plate including a first and second strap receiving slot 24 and 25 respectively formed proximate the lateral edges thereof. The base plate or bracket half 21 is furthermore convolved along one longitudinal edge to form a lip 26 aligned on an acute angle relative the plate surface. Lip 26, furthermore is formed to provide a plurality of interiorly directed serrations or ridges 27, each ridge 27 having a triangular section biased towards the opposing surface of the bracket. Plate 21 furthermore includes two lateral recesses 28 and 29, each recess including once more, longitudinally aligned ridges or serrations 30 on the bottom surface thereof. Once more, the ridges 30 are triangular in section biased to lean towards the lip 26.

The other half of the bracket or the locking plate 22 is provided with two planar parallel tongues 31 and 32 conformed for inward receipt in the corresponding recesses 28 and 29. Tongues 31 and 32, on the underside, are similarly provided with a plurality of ridges 33 conformed to mate with the ridges or serrations 30 in the respective recesses. By virtue of this surface arrangement the locking plate 22 may be set and engaged to plate 21 at various levels of lateral insertion. To provide the necessary grasping or clamping feature, plate 22 furthermore includes lateral edge lip 36 similarly conformed to a direction partly overlying the surface of the tongues 31 and 32 and including on its interior a plurality of ridges 37 providing the same function as the ridges 27 on the plate 21.

A third tongue 39 offset and interposed between tongues 31 and 32 extends from the lip 36 to engage the lower surface of plate 21 thus providing the necessary spring bias engaging the various ridges.

In addition, the passage of the strap 23 over the tongues 31 and 32 and the plate 21 enhances this securing feature, the two bracket halves being cinched down by the cinching of the wrist band.

As an alternative to the above clamping device, a device set out in FIG. 4 may be utilized. More specifically, shown in FIG. 4 is a bracket assembly generally designated by the numeral 50. Assembly 50 once more rectangular in form includes at the lateral edges thereof spirally wound surface extensions 51 and 52 respectively. The thickness of each edge extension is tapered along with the spiral to provide the desired spring coefficient. Again a strap 53, passed through two slots 54 and 55, engages the bracket assembly 50 to the wrist of a person, the spiral edges providing the necessary bias in order to retain an object therebetween.

In both instances it is contemplated to utilize plastic materials to form the bracket structures. More specifically the structure of the first clamping device can be manufactured from a material like polyethylene with the requisite rigidity offered thereby. The bracket assembly 50, on the other hand, is better achieved from a plastic like ABS having the larger flexure constants in order to accommodate a wide range of object sizes within a single structural element.

Some of the advantages of the present invention should now be readily apparent. The invention provides by way of simple and conveniently produced structural elements a structural clamp adapted to engage objects of various sizes. Furthermore, the invention provides this clamping function in structures comprising thin plastic stock, thereby reducing the weight entailed and the cost of manufacture.

Obviously many modifications and variations to the above disclosure can be made without departing from the spirit of the invention. It is therefore intended that the scope of the invention be determined solely by the claims attached hereto.

I claim:

1. A securing device deployable on the arm of a person for securing electric calculators and the like comprising:

bracket means including a first bracket half formed as an L-shaped surface having a first and second slot respectively proximate the transverse edges thereof, said L-shaped surface comprising a substantially rectangular plate joined to a first planar lip along one longitudinal edge thereof, the alignment of said lip relative said plate being at an acute angle in partial overlap over said plate, a second bracket half comprising a plurality of tongue members joined at an acute angle to a second partly overlapping planar lip, said plate including a corresponding set of planar transversely aligned recesses, each conformed to the planar form of a corresponding one of said tongues, the adjacent surfaces of said tongues and said recesses each including mating ribs for providing engagement therebetween, said first and second lips each include longitudinal serrations formed on the opposed surfaces thereof, said ribs comprise longitudinally aligned elongate projections having a triangular section, the apex of each rib being biased to allow insertion of said tongues into said recesses and to oppose withdrawal therefrom, whereby said first and second halves are alignable to mate said tongues and said recesses at various spacings relative to each other to deploy said first and second lips in a deforming and frictional fit around the edges of said calculator; and strap means insertable through said slots for securing said bracket means to a person.

2. Apparatus according to claim 1 wherein said bracket means comprises plastic structure.

* * * * *